US009593565B2

(12) United States Patent
Lecerf et al.

(10) Patent No.: US 9,593,565 B2
(45) Date of Patent: Mar. 14, 2017

(54) WELLSITE HANDLING SYSTEM FOR PACKAGED WELLSITE MATERIALS AND METHOD OF USING SAME

(71) Applicant: Schlumberger Technology Corporation, Sugar Land, TX (US)

(72) Inventors: Bruno Lecerf, Houston, TX (US); Dan Fu, Kuala Lumpur (MY); Zinaida Usova, Sugar Land, TX (US); Avinash Ramesh, Houston, TX (US); Garud Sridhar, Sugar Land, TX (US); William Troy Huey, Sugar Land, TX (US); Jesse Lee, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 445 days.

(21) Appl. No.: 14/030,711

(22) Filed: Sep. 18, 2013

(65) Prior Publication Data

US 2015/0075796 A1 Mar. 19, 2015

(51) Int. Cl.

| | |
|---|---|
| ***E21B 41/00*** | (2006.01) |
| ***E21B 43/16*** | (2006.01) |
| ***E21B 44/00*** | (2006.01) |
| ***E21B 27/02*** | (2006.01) |
| ***E21B 27/04*** | (2006.01) |
| ***E21B 21/06*** | (2006.01) |

(52) U.S. Cl.

CPC ..... *E21B 44/00* (2013.01); *E21B 21/062* (2013.01)

(58) Field of Classification Search

CPC ..... C09K 8/805; E21B 41/00; E21B 21/062; E21B 44/00

See application file for complete search history.

(56) References Cited

U.S. PATENT DOCUMENTS 1,916,531 A * 7/1933 Robb ..... B28C 7/064 198/307.1
4,023,706 A * 5/1977 Dearlove ..... B28C 5/404 106/644

(Continued)

FOREIGN PATENT DOCUMENTS

WO 2013085410 A1 6/2013

OTHER PUBLICATIONS

International Search Report and Written Opinion issued in PCT/US2014/055725 on Dec. 30, 2014; 11 pages.

(Continued)

*Primary Examiner* — Tony G Soohoo
(74) *Attorney, Agent, or Firm* — Michael L. Flynn

(57) ABSTRACT

Systems and methods for handling wellsite packets for a wellsite are provided. The wellsite packets include soluble packaging with wellsite materials therein. The wellsite has surface equipment and downhole equipment positioned about a wellbore. The handling system includes at least one feeder, at least one mixer, at least one metering device, and a pump. The feeder moves the wellsite packets directly or indirectly into the mixer. The mixer stimulates dissolution of the soluble packaging so as to mix the wellsite materials with a fluid to form a wellsite mixture. The metering device selectively controls the number of wellsite packets moving to the mixer. The pump is operatively coupled to the mixer to pump the wellsite mixture at the wellsite.

5 Claims, 8 Drawing Sheets

(56) References Cited

U.S. PATENT DOCUMENTS 4,453,829 A 6/1984 Althouse
4,808,004 A 2/1989 McIntire et al.
4,946,339 A * 8/1990 Berg ..... B65B 69/0058 414/403
5,030,314 A * 7/1991 Lang ..... A61F 13/15634 156/390
5,190,374 A 3/1993 Harms et al.
5,807,458 A * 9/1998 Sanders ..... B28B 1/52 156/276
5,985,449 A * 11/1999 Dill ..... C04B 16/06 428/359
7,042,272 B2 5/2006 Dornbusch
7,049,272 B2 5/2006 Sinclair et al.
7,490,449 B1 * 2/2009 Eibert ..... B29C 65/1467 493/967
8,545,091 B1 * 10/2013 Arribau ..... B01F 5/22 366/167.2
2004/0109384 A1 * 6/2004 Dewinter ..... B01F 15/0205 366/150.1
2008/0135245 A1 * 6/2008 Smith ..... C04B 35/04 166/280.2
2008/0179092 A1 7/2008 Fragachan et al.
2009/0148632 A1 * 6/2009 Danielsson ..... B28C 5/402 428/34.1
2010/0038077 A1 2/2010 Heilman et al.
2010/0188926 A1 * 7/2010 Stegemoeller ..... B01F 3/1221 366/137
2010/0243252 A1 9/2010 Luharuka et al.
2011/0024129 A1 * 2/2011 Turakhia ..... C09K 8/805 166/369
2011/0061855 A1 3/2011 Case et al.
2011/0155373 A1 6/2011 Goddard et al.
2012/0199356 A1 * 8/2012 Nichols ..... B01F 3/1221 166/308.1
2012/0227967 A1 * 9/2012 Shaikh ..... C09K 8/805 166/280.1
2012/0231982 A1 * 9/2012 Weinstein ..... B01F 3/088 507/213
2012/0285695 A1 11/2012 Lafferty et al.
2013/0105166 A1 * 5/2013 Medvedev ..... E21B 43/267 166/308.1
2014/0000891 A1 * 1/2014 Mahoney ..... C09K 8/805 166/280.2
2014/0034310 A1 * 2/2014 Andersen ..... E21B 34/14 166/281
2014/0041317 A1 2/2014 Pham et al.
2014/0041319 A1 2/2014 Pham et al.
2014/0041322 A1 2/2014 Pham et al.
2014/0102695 A1 * 4/2014 Adil ..... E21B 47/065 166/250.01
2015/0075796 A1 * 3/2015 Lecerf ..... E21B 44/00 166/305.1
2015/0103869 A1 * 4/2015 Moscato ..... E21B 47/065 374/185
2015/0135817 A1 * 5/2015 Moscato ..... E21B 47/00 73/152.33
2015/0167447 A1 * 6/2015 Tjhang ..... E21B 47/0002 348/85
2015/0192006 A1 * 7/2015 Ramesh ..... B02C 23/20 166/305.1
2015/0198015 A1 * 7/2015 Barreto ..... E21B 43/25 166/250.01

OTHER PUBLICATIONS

Pham et al., U.S. Appl. No. 13/838,872, filed Mar. 15, 2013; 31 pages.
Pham et al., U.S. Appl. No. 13/839,088, filed Mar. 15, 2013; 29 pages.
Pham et al., U.S. Appl. No. 13/839,368, filed Mar. 15, 2013; 29 pages.

* cited by examiner

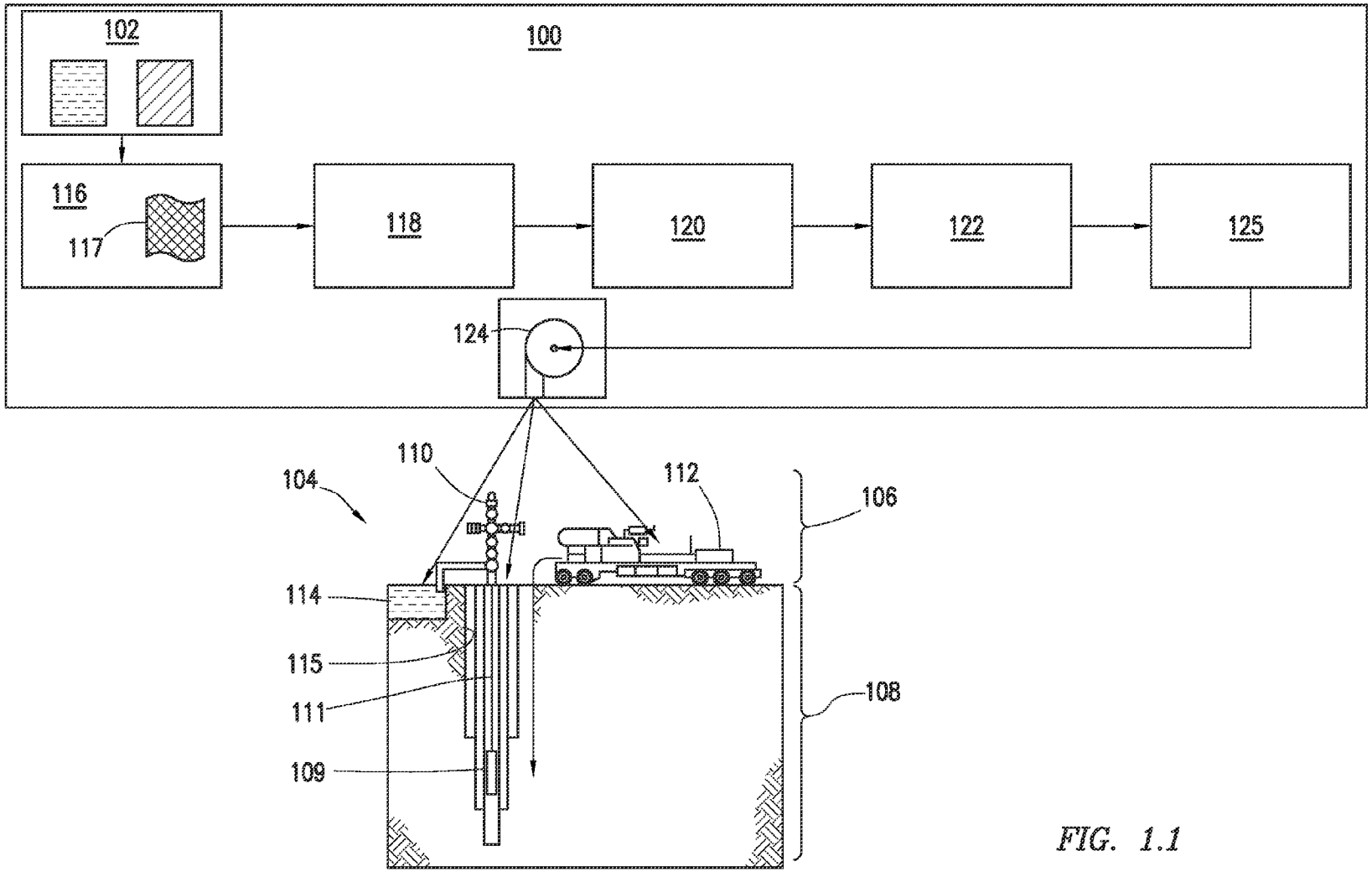
FIG. 1.1

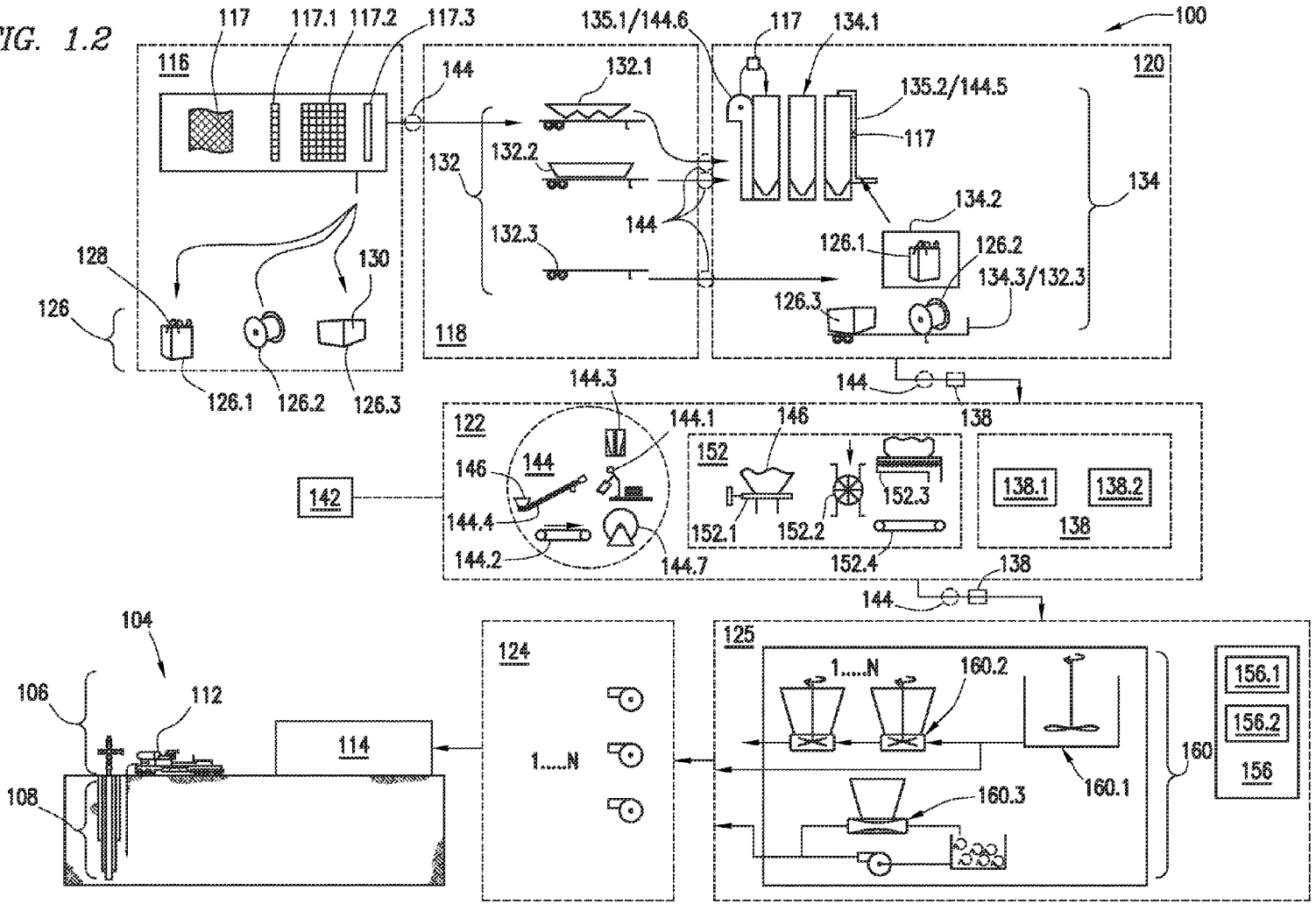
FIG. 1.2

FIG. 2.1
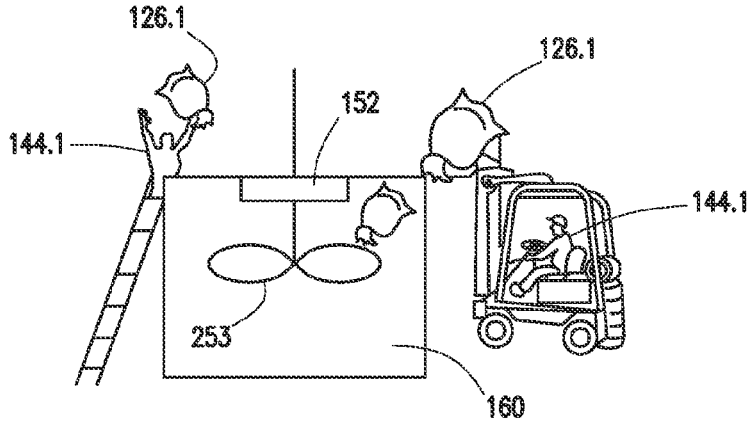
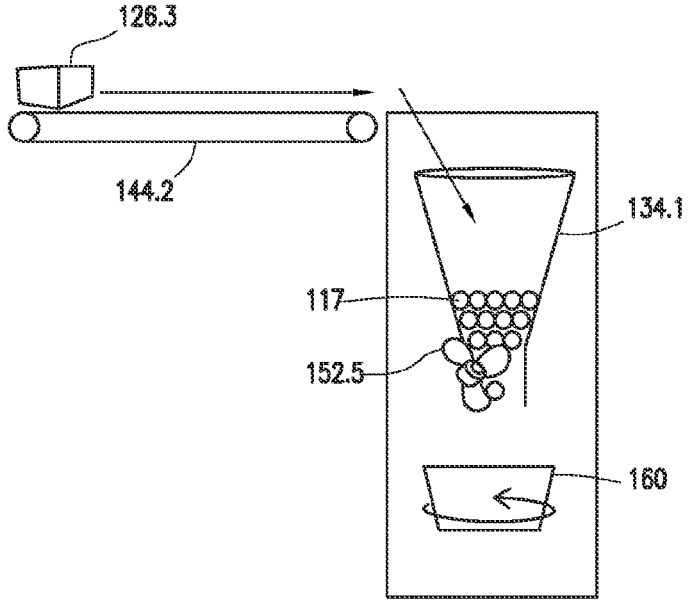
FIG. 2.2
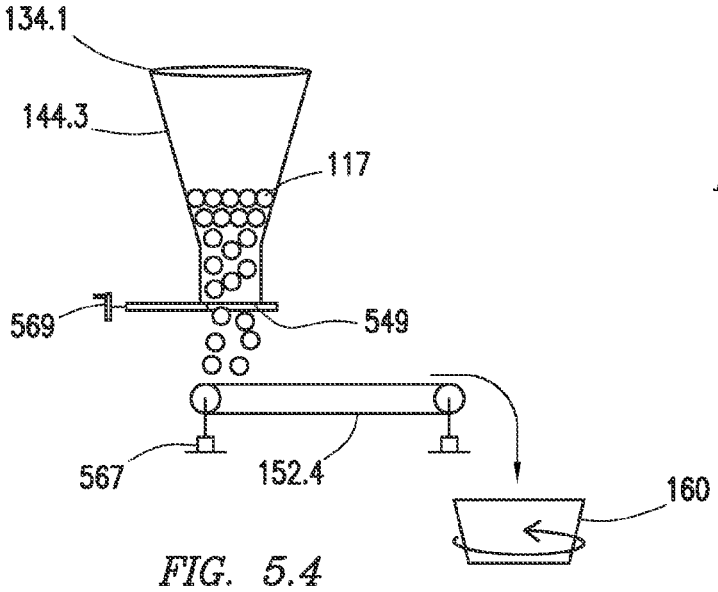
FIG. 5.4

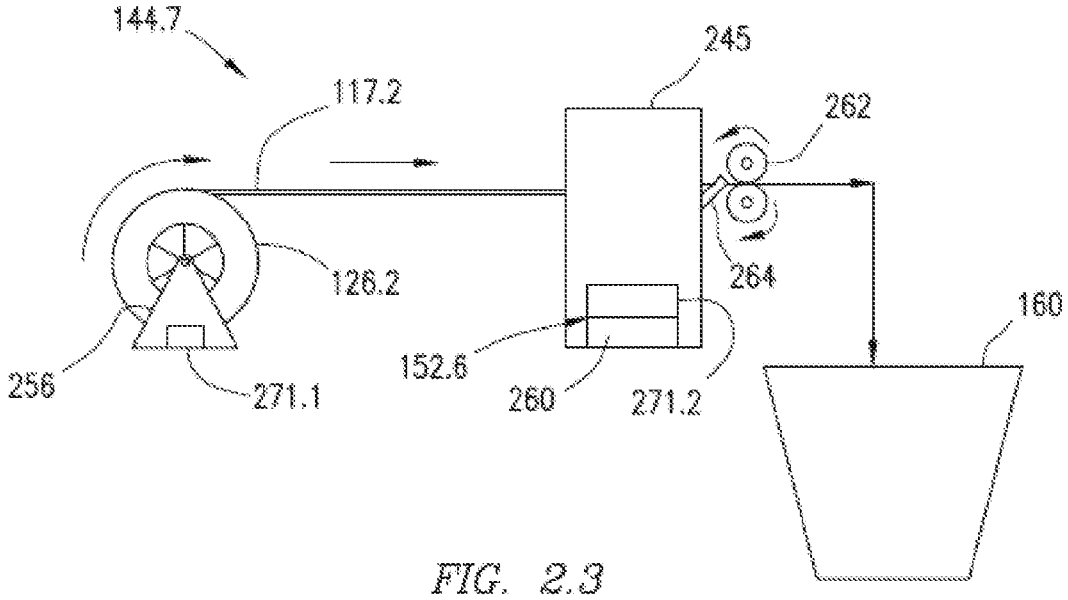
FIG. 2.3
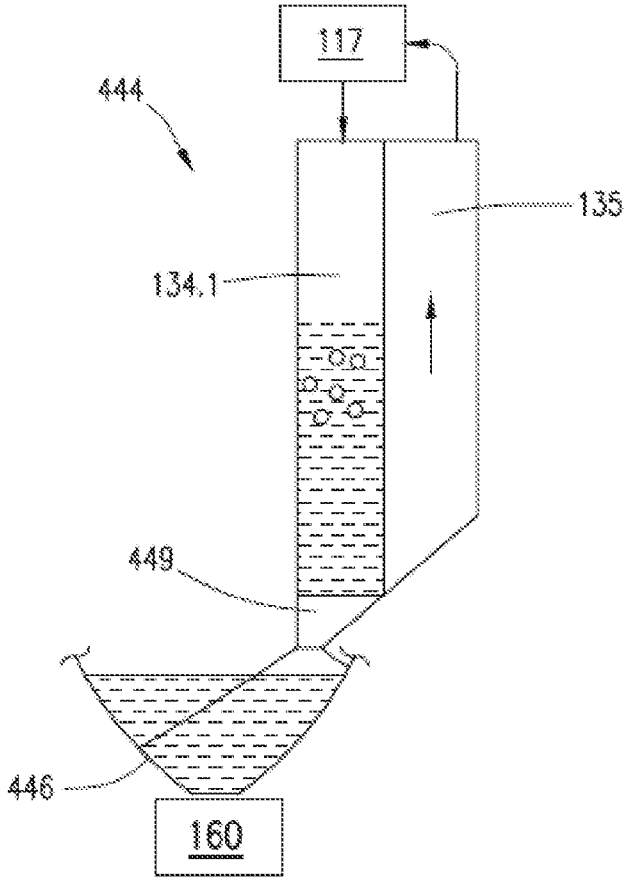
FIG. 4

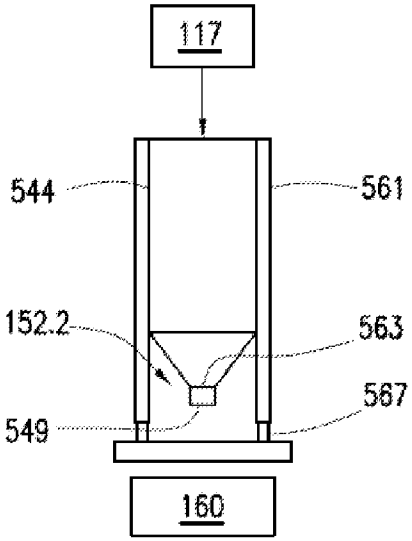
FIG. 5.2
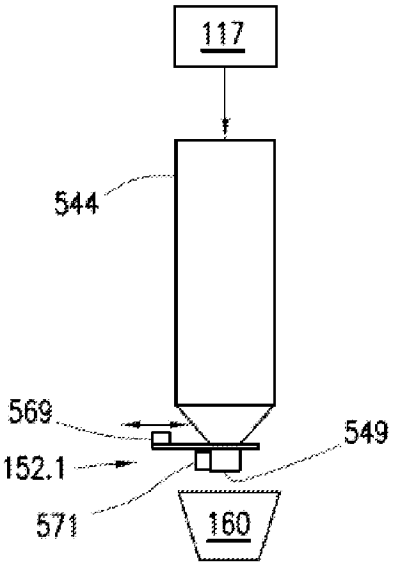
FIG. 5.3
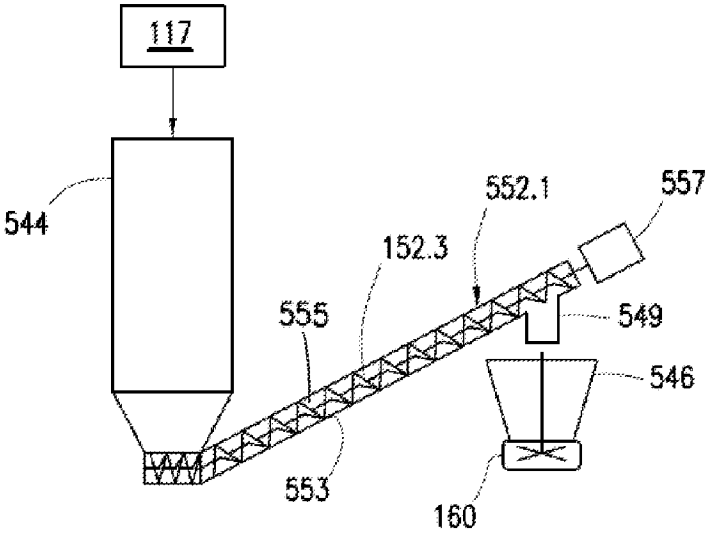
FIG. 5.1

WELLSITE HANDLING SYSTEM FOR PACKAGED WELLSITE MATERIALS AND METHOD OF USING SAME

BACKGROUND

The present disclosure relates generally to methods and systems for performing wellsite operations. More particularly, this disclosure is directed to methods and systems for handling wellsite materials, such as treatment fluid, stimulation fluid, drilling muds, etc.

Wellsite operations may be performed to locate and capture valuable subsurface fluids, such as hydrocarbons. Wellbores may be drilled by advancing drilling tools into the earth to reach the subsurface fluids. Production equipment may be deployed into the wellbore to transport the hydrocarbons to the surface. In some cases, formations surrounding the wellbore may be treated to facilitate the flow of fluids to the surface. Treatment may involve injecting fluid into the wellbore to fracture the subsurface formations and provide pathways for fluid flow into the wellbore.

Various fluids may be delivered to the wellsite to perform wellsite operations. For example, during drilling, drilling fluids (e.g., muds) may be pumped into the wellbore to facilitate drilling and/or to line the wellbore. In another example, during production, treatment/stimulation fluid may be injected into the formation to fracture the formations. Such injected treatment/stimulation fluid may include, for example, acids to enhance the fractures, proppants to prop open the fractures, and the like. Various techniques may be used to deliver the treatment/stimulation fluid to the wellsite. Examples of treatment/stimulation fluid used at a wellsite are provided in Patent/Application Nos. US2012/0285695, U.S. Pat. No. 7,049,272, and PCT/RU/2011/000969.

SUMMARY

In at least one aspect, the present disclosure relates to a system for handling wellsite packets for a wellsite. The wellsite packets include soluble packaging with wellsite materials therein. The wellsite has surface equipment and downhole equipment positioned about a wellbore penetrating a subterranean formation. The handling system includes at least one feeder to move the wellsite packets directly or indirectly into at least one mixer, wherein the at least one mixer is capable of stimulating dissolution of the soluble packaging so as to mix the wellsite materials with a fluid to form a wellsite mixture. A metering device is provided to selectively control a number of wellsite packets moving to the at least one mixer, and a pump is operatively coupled to the mixer to pump the wellsite mixture at the wellsite.

In another aspect, the present disclosure relates to a system for handling wellsite packets for a wellsite. The wellsite packets include packaging with wellsite materials therein. The wellsite has surface equipment and downhole equipment positioned about a wellbore penetrating a subterranean formation. The handling system includes at least one feeder having a reel rotationally mounted on a reel support. The feeder also includes a chain of the wellsite packets releasably wound about the reel so that the chain of wellsite packets is unwindable from the reel and into at least one receptacle. The system also includes at least one mixer operatively coupled to the receptacle. The mixer functions to mix the wellsite packets with a fluid to form a wellsite mixture. The system further includes a pump operatively coupled to the mixer to pump the wellsite mixture to the wellsite.

In another aspect, the present disclosure relates to a method of handling wellsite packets for a wellsite. The wellsite packets include packaging with wellsite materials therein. The wellsite has surface equipment and downhole equipment positioned about a wellbore penetrating a subterranean formation. The method includes moving the wellsite packets directly or indirectly into at least one mixer via at least one feeder. The method also includes selectively controlling a number of wellsite packets moving into the at least one mixer using a metering device. The method further includes forming a wellsite mixture by mixing the wellsite packets with a fluid using the at least one mixer, and pumping the wellsite mixture to the wellsite with a pump.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

Embodiments of the wellsite handling system and method are described with reference to the following figures. The same numbers are used throughout the figures to reference like features and components.

FIGS. 1.1 and 1.2 are schematic illustrations of wellsite handling systems including packaging, transportation, storage, delivery, mixing, and pump portions in accordance with an embodiment of the present disclosure;

FIGS. 2.1-2.3, 3 and 4 are schematic illustrations of various configurations of a delivery portion of a wellsite handling system in accordance with an embodiment of the present disclosure;

FIGS. 5.1-5.4 are schematic illustrations of various metering devices in accordance with an embodiment of the present disclosure;

DETAILED DESCRIPTION

Figure 3:
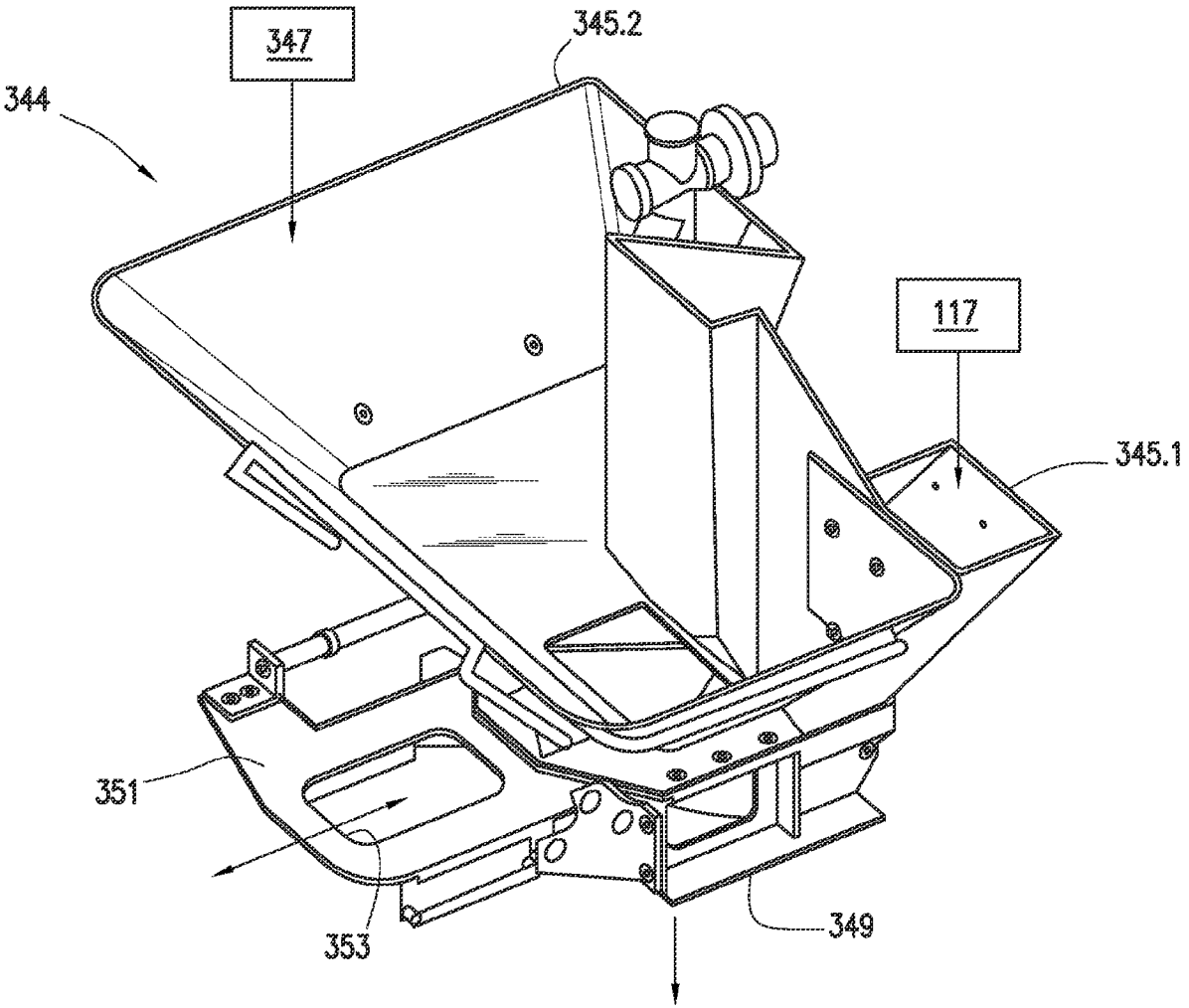

The description that follows includes exemplary apparatuses, methods, techniques, and instruction sequences that embody techniques of the inventive subject matter. However, it is understood that the described embodiments may be practiced without these specific details.

Unless expressly stated to the contrary, "or" refers to an inclusive or and not to an exclusive or. For example, a condition A or B is satisfied by anyone of the following: A is true (or present) and B is false (or not present), A is false (or not present) and B is true (or present), and both A and B are true (or present).

In addition, use of the "a" or "an" are employed to describe elements and components of the embodiments herein. This is done merely for convenience and to give a general sense of the inventive concept. This description should be read to include one or at least one and the singular also includes the plural unless otherwise stated.

The terminology and phraseology used herein is for descriptive purposes and should not be construed as limiting in scope. Language such as "including," "comprising," "having," "containing," or "involving," and variations thereof, is intended to be broad and encompass the subject matter listed thereafter, equivalents, and additional subject matter not recited.

Finally, as used herein any references to "one embodiment" or "an embodiment" means that a particular element, feature, structure, or characteristic described in connection with the embodiment is included in at least one embodiment. The appearances of the phrase "in one embodiment" in various places in the specification are not necessarily referring to the same embodiment.

The disclosure relates to a handling system for providing wellsite materials to a wellsite for use in drilling, treatment, injection, fracturing, and/or other wellsite operations. Part or all of the wellsite materials may be pre-packaged in wellsite packets. The wellsite packets may have soluble (e.g., water soluble) packaging for releasing the wellsite materials for mixing with fluids to form wellsite mixtures that may be pumped to surface and/or downhole locations at a wellsite. The handling system includes a packaging portion, transportation portion, storage portion, delivery, mixing and/or pumping portion for providing the wellsite packets to the wellsite.

"Wellsite materials" as used herein refers to wellsite fluids and/or solids, such as chemicals, proppants, fibers, and/or drilling muds. By way of example, the wellsite materials may include solid proppant added to fracturing fluid, solid and/or liquid chemical additives added to fracturing slurry (e.g., fibers, particulates, crosslinkers, breakers, corrosion inhibitors), fibers and particulates (and other lost circulation materials) added to treatment pills (preventative or remedial), solid hydrofluoric (HF) acid precursor added to acid solution (e.g., hydrofluoric, NH4HF2) for sandstone acidizing, solid cement additives added during cementing operations, and/or other solid and/or liquid wellsite components.

"Wellsite packets" refer to discrete packages of wellsite materials. The wellsite packages include specified solid and/or liquid components packaged in specified amounts into packaging, such as containers, coatings, plastics, shrink wrap, and/or the like, that may be soluble. The packaging may be used to prevent exposure of the wellsite materials to air or other potentially detrimental materials. The packaging may also include components that act as part of the materials used in treatment, and optionally may be reusable. The wellsite packets may be individual wellsite packets, a long tubular wellsite packet or multiple individual wellsite packets joined together in chains or sheets. The wellsite packets may be mixed with fluid(s) to form "wellsite mixtures." Examples of wellsite mixtures may include: stimulation fluid, such as acid; fracturing fluid for hydraulic fracturing, such as proppant laden fluid (gas or liquid, e.g., water), and various additives; drilling mud; cement slurry; treatment fluid, such as surface water treatment; or other wellsite fluids that may or may not include particle(s), fiber(s) or other solids.

FIGS. 1.1 and 1.2 depict example wellsite handling systems 100 for providing wellsite materials 102 to a wellsite 104. The wellsite 104 includes surface equipment 106 and downhole equipment 108. As shown, the surface equipment 106 includes a Christmas tree 110 and one or more fluid sources, such as treatment fluid system 112 and mud system 114. The downhole equipment 108 may include downhole tool 109 and/or downhole tubing 111 used for downhole operations in wellbore 115.

As shown in FIG. 1.1, the handling system 100 includes a packaging portion 116, a transportation portion 118, a storage portion 120, a delivery portion 122, a mixing portion 125, and a pumping portion 124. The packaging portion 116 may be used to receive and package the wellsite materials 102. As shown, the wellsite materials 102 may include liquid and/or solid components which may be inserted into packaging by the packaging portion 116 to form one or more individual wellsite packets 117.

The wellsite packets 117 may be sized and shaped for convenient transportation by transportation portion 118, storage by storage portion 120, delivery by delivery portion 122, mixing by mixing portion 125, and pumped by pumping portion 124 for use at the wellsite 104. The delivery portion 122 may deliver the wellsite packets 117 to the mixing portion 125 where the wellsite packets 117 may be mixed with other materials to form a wellsite mixture. The pumping portion 124 may be used for pumping the wellsite mixture to surface and/or downhole locations at the wellsite as indicated by the arrows.

FIG. 1.2 depicts an example configuration of the various portions 116, 118, 120, 122, 125 and 124 of a handling system 100 of FIG. 1.1. The packaging portion 116 depicts various examples of packaging of the wellsite packets 117. As shown, the wellsite packets 117 may be provided individually, or assembled into multiples sets of individual wellsite packets 117, such as in chains 117.1, sheets 117.2, and/or in a continuous tubing 117.3 (e.g., like a sausage).

One or more of the wellsite packets 117 may be placed in a carrier 126 for storage and/or transport. Examples of carriers as depicted may include containers 126.1, reels 126.2, and pallets 126.3. The container 126.1 may be, for example, a hard container, such as a plastic bin, or soft sided container, such as a sack or super sack, for receiving the wellsite packets 117. The container 126.1 may optionally be provided with handles 128 to facilitate lifting and/or transport. The containers 126.1 may be configured to receive the wellsite packets 117, 117.1, 117.2.

The reels 126.2 may be spools that carry the chain 117.1 of wellsite packets 117 wound about the reel 126.2. In this version, multiple wellsite packets 117 may be wound around the reel 126.2 for storage and transport, and unwound from the reel 126.2 for use.

The pallets 126.3 may be horizontal platforms capable of supporting the chain 117.1 of wellsite packets 117 thereon. Containers 126.1 and/or reels 126.2 may be positioned onto the pallets 126.3 to be lifted, for example, by forklifts. In another example, the pallets 126.3 may have a cover (or wrapping) 130 to contain the wellsite packets 117 therein. The cover 130 may be a plastic, such as a water insoluble film. The pallets 126.3 may optionally be provided with framing to permit the pallets 126.3 to be stacked and/or protected.

Transportation portion 118 is depicted as including one or more transporters 132 that may be used to transport the wellsite packets 117. Transporter 132 may be any equipment capable of carrying the carriers 126 and/or the wellsite packets 117 to a desired location. As shown, the transporter may be, for example, a pneumatic transport 132.1, a belly dump transport 132.2, a flatbed trailer (or freight hauler) 132.3, or other means (e.g., rails) for transporting loads. The transporter 132 may be configured to carry the wellsite packets 117 and/or other materials (e.g., solids, fluids, containers, etc.) used with the wellsite packets 117 or used for wellsite operations.

The storage portion 120 is depicted as a housing 134 for containing the wellsite packets 117. The storage equipment 134 may be any equipment capable of storing a desired number of wellsite packets 117, carriers 126 and/or transporter 134. For example, the housing 134 may be silos 134.1 for receiving the wellsite packets 117.

In one example configuration, the silos 134.1 may be configured such that the wellsite packets 117 may be dropped into an upper portion of the silo 134.1 and selectively discharged at a lower portion of the silo 134.1 for delivery by the delivery portion 122. As depicted, a container 126.1 of individual wellsite packets 117 may be poured into the upper portion of the silos 134.1 for storage. Optionally, a bucket elevator (or lifter) 135.1 or other type of vertical conveyor may be provided to receive and lift one or more wellsite packets 117 into the upper portion of the silo 134.1 as indicated by the arrows. Examples of bucket elevators 135.1 and silos 134.1 are provided in U.S. application Ser. Nos. 13/838,872, 13/839,088, and Ser. No. 13/839,368, each of which is incorporated herein by reference in their entirety. In another example, a pneumatic conveyor 135.2 may optionally be provided to move wellsite packets 117 into the silos 134.1.

As also depicted, a warehouse (or shed or other building) 134.2 may be provided to house the wellsite packets 117. Transporter 132.3 may act as a storage vessel 134.3 for housing wellsite packets 117 and/or carriers 126.2, 126.3. In some cases, as also shown, the carriers 126 and/or transporters 132 may themselves act as housing 134 for storing wellsite packets 117 at a desired location. In at least one of the examples shown, wellsite packet 117 is passed into silo 134.1, carrier 126.1 is placed in warehouse 134.2, and pallet 126.3 and reel 126.2 is positioned on transporter 132.3/134.3.

To facilitate transport and/or storage of the wellsite packets 117 and prevent potential deterioration that may occur over time due to, for example, moisture. Various means may be provided to protect the wellsite packets 117. For example, a desiccant or detackifier may be provided to prevent the packaging from deteriorating and/or adjacent wellsite packets from sticking together. For example, a powder may be used as a detackifier, such as a proppant, talc, magnesium stearate, and the like may be used to prevent sticking. The detackifier or other material used to prevent deterioration may also be a component that serves a function, such as solid lubrication, at wellsite operations.

The delivery portion 122 is depicted as including various delivery devices, such as a feeder 144, a metering device 152, and a breaking device 138. The feeder 144 may be coupled to storage portion 120 and/or the various housings 134, for moving the wellsite packets 117 from the storage portion 120 and on to the mixing portion 125. For example, the wellsite packets 117 may dump directly from the silos 134.1 into the feeder 144, or be passed in the carriers 126 and/or transporters 132 to the feeder 144.

As shown, the feeder 144 may be provided at various locations along the handling system 100 to move the wellsite packets 117 from any location between transport 118 and pumping 124 to any location between transport 118 and pumping 124. The feeder 144 may be configured to manually or automatically receive and pass the wellsite packets 117 to the mixing portion 125. For example, as shown, the feeder 144 may be an operator 144.1 for manually feeding the wellsite packets 117; the feeder 144 may be direct feeding 144.3 by way of gravity; or, the feeder 144 may be automated feeding, such as, a belt-type conveyor 144.2, an auger (metering screw) 144.4, a pneumatic conveyor 135.2/144.5, a bucket elevator 135.1/144.6, a reel injector 144.7, and/or any combination thereof for moving the wellsite packets 117 within the handling system 100.

The feeder 144 may optionally be provided with a receptacle 146 to receive one or more wellsite packets 117 from any location between transport 118 and mixing 125. The feeder 144 may also include the metering device 152 to meter and/or distribute the wellsite packets 117 as they pass therethrough. The metering device 152 may be used to provide a certain number of wellsite packets 117 for use. The metering device 152 may also be used to pass a certain amount of the wellsite materials (e.g., fibers) that may be prone to clogging or plugging of equipment. As shown in FIG. 1.2, the metering device may be, for example, a gate valve 152.1, a rotary valve 152.2, an auger 152.3, a conveyer 152.4, or rotary blade 152.5. The metering device 152 may be operatively connected to the receptacle 146 to control passage of wellsite packets 117 therethrough.

Optionally, the breaking device 138, such as a dissolver 138.1 and/or a breaker 138.2, may be provided to open the wellsite packets 117 to release the wellsite materials. The dissolver 138 may be, for example, mechanical (e.g., a shredder), chemical (e.g., a solvent), or physical (e.g., temperature, pressure). The breaking device 138 may be positioned about the handling system 100, for example, before or after the delivery portion 122 as shown.

As shown, the dissolver 138.1 may be a chemical device, such as a steamer or a chemical (e.g., a solvent), to facilitate the breaking down of the wellsite packets 117. The dissolver 138 may also be used to begin breaking down the packaging and/or the wellsite materials of the wellsite packets 117 to facilitate mixing. The breaker 138.2 may be, for example, a knife, shredder, steamer or other device capable of opening the packaging to release the wellsite materials.

The wellsite packets 117 and/or wellsite materials from the feeder 144 are passed to the mixing portion 125 for mixing. The mixing portion 125 includes a mixers 160, and fluid sources 156. The mixing portion 126 may be provided to mix the wellsite packets 117 and/or fluids from fluid sources 156 to form the wellsite mixture. The fluid sources 156 may include fluids 156.1 and/or additives 156.2. The fluids 156.1 may be, for example, water, or other aqueous fluids capable of dissolving and/or mixing with the wellsite packets 117 to form wellsite mixtures usable at the wellsite. The additives 156.2 may be, for example, oxidizers, acids and/or reactive chemicals that may be added along the handling system 100 and/or at the wellsite 104 for altering the wellsite mixture as desired.

The mixing portion 125 may be provided with one or more mixers 160 to form the wellsite mixture. For example, the mixers 160 may include a batch mixer 160.1 to provide batch mixing and/or one or more continuous mixers 160.2 to provide continuous (or on the fly) mixers. The various mixers may be provided to mix the wellsite packets 117, fluids 156.1, and/or additives 156.2 to generate the wellsite mixture. By way of example, a first mixer may be a high energy mixer capable of dispersing solids in the wellsite packets 117 into a concentrated wellsite mixture, and a second mixer may be provided to dilute the concentrated wellsite mixture into a fluid mixture. Various examples of mixers are shown and described in US Patent Publication Nos. US2011/0155373 or US2010/0243252 and U.S. Pat. No. 4,453,829 or U.S. Pat. No. 4,808,004, each of which is incorporated herein by reference in their entirety.

A control unit 142 may be operatively connected to one or more portions of the handling system 100 to monitor various parameters of the equipment and/or wellsite materials. Sensors may be provided for measuring one or more parameters (e.g., quantity of wellsite packets 117 and/or wellsite materials passing through portions of the handling system 100) as desired. The control unit 142 may also control the operation of various aspects of the handling system 100. The control unit 142 may include various components, such as processors, computers, or other devices for monitoring and/or controlling the handling system 100.

FIGS. 2.1-2.3 shows examples of feeders 144.1, 144.2, 144.3 and 144.7 for receiving the wellsite packets 117 (either individually or in multiples). FIG. 2.1 show manual feeders 144.1 and FIGS. 2.2 and 2.3 show automatic feeders 144.2 and 144.3. As shown in FIG. 2.1, the wellsite packets 117 may be manually deployed in carriers 126.1 into the mixer 160 by manual feed using an operator 144.1. The operator 244.1 may dispense the wellsite packets 117 by hand or using equipment (e.g., forklift) as shown.

As also shown in FIG. 2.1, a metering device 152 is provided to control the number of wellsite packets 117 entering into the mixer 160. The mixer 160 may have a blade 253 to rotate the wellsite packets 117 and to facilitate break down of the wellsite packets 117 and/or wellsite materials therein.

As shown in FIG. 2.2, the wellsite packets 117 may be fed into a receptacle by direct feeder, for example, by conveyor (e.g., belt-type) 144.2. As shown in FIG. 2.3, the wellsite packets 117 may be deployed into a silo 134.1 on pallets 126.3. The conveyor 144.2 may also be used as a metering device 152.4, for example, by positioning the conveyor 144.2 between any devices (e.g., feeder 144, receptacle 146, or mixer 160) to provide wellsite packets 117 in desired increments.

A metering device 152.5 in the form of a blade (or turnstile) is provided in the silo 134.1 to selectively permit the passage of wellsite packets 117 therethrough. The metering device 152.5 may rotate such that the wellsite packets 117 passing therethrough are broken down and selectively permit the wellsite materials to pass into the mixer 160. As indicated by the curved arrow, a vortex may be created as the wellsite materials are spun into the mixer 160.2 to rotationally mix the wellsite materials.

As shown in FIG. 2.3, feeder 144.7 may include a reel 126.2 for dispensing the wellsite packets 117 automatically or manually through a reel injector 245. Chains 117.2 of wellsite packets 117 may be unwound from reel 126.2 and passed into a mixer 160. A reel support 256 may be provided to support the reel 126.2 for dispensing of the wellsite packets 117. A motor 260 may optionally be provided to drive the reel 126.2.

Drums 262 may optionally be provided to pull the chain 117.2 of wellsite packets 117 from reel 126.2 and/or to separate a cover therefrom. As an example, the reels 126.2 may pull a plastic cover from the chain 117.2 of the wellsite packets onto the drums 262 and release the wellsite materials into the receptacle 246.3. A knife 264 may optionally be provided to cut the chain 117.2 of wellsite packets 117.

FIG. 3 is a schematic view of a hopper 344 usable as a feeder 144 and/or receptacle 146. The hopper 344 may be, for example, a bin having multiple intakes 345.1, 345.2 to receive wellsite packets 117 and other inputs 347 (e.g., bulk materials or fluids). Intake 345.1 may be provided to receive the wellsite packets 117, and the intake 345.2 may be provided to receive other inputs, such as fluids, solids or other materials mixed with the wellsite packets 117 to form wellsite mixtures.

As shown, the hopper 344 may have an outlet 349 that merges the wellsite packets 117 with the inputs 347, and a metering device 351. The metering device 351 as shown is a gate assembly 351 with a passage 353 therethrough. As indicated by the two-way arrow, the gate assembly 351 includes a gate valve is movable between a closed position preventing the passage of materials from the hopper 344 and out outlet 349, and an open position aligning the passage 351 with the intakes 345.1 and/or 345.2 to permit the materials to pass therethrough. The hopper 344 may also be coupled to and/or be used as a receptacle 146.

FIG. 4 depicts a feeder 444 and a receptacle 446. The feeder 444 may be one or more silos 134.1 for receiving wellsite packets 117. The feeder 444 may have a tapered outlet 449 that dispenses into a receptacle 446. The receptacle 446 may then dispense into the mixer 160. As shown, the feeder 444 may include a bucket elevator 135 to facilitate input of the wellsite packets 117 into the feeder 444. Where multiple silos are provided, the silos may selectively pass (simultaneously or alternately) into one or multiple mixers through one or more metering devices 152. For example, multiple silos may feed various combinations of wellsite materials into one or more mixers to achieve a desired concentration and/or feed rate.

FIGS. 5.1-5.3 depict various examples of metering devices 152.1-152.3 in use. The metering device is coupled between a feeder 544 and the mixer 160. The feeder 544 is depicted as a silo receiving the wellsite packets 117 and dropping the wellsite packets 117 to the metering device 152.1-152.3.

As shown in FIG. 5.1, the metering device 152.3 is an auger including a tubular housing 553 with a rotational screw 555 and a motor 557. The wellsite packets 117 are dropped into the auger 152.3 and advanced along the screw 555 as it is rotationally driven by motor 557. The rotation of the screw 555 with the tubular housing 553 forms a gate 555 to prevent or advance the wellsite packets 117. The wellsite packets 117 are driven along rotational screw 555 and dropped through outlet 549 into a receptacle 546 and on to mixer 160. The size and rotation of the screw 555 may be varied to alter the amount of wellsite packets 117 that pass to the mixer 160.

As shown in FIG. 5.2, the metering device 152.2 is a gate assembly including a rotary valve 563 positioned on a dispensing end of silo 544. The rotary valve 563 may be rotationally movable between an open and closed position to selectively release wellsite packets out outlet 549 and into mixer 160.

As also shown this FIG. 5.2, a gauge 567 may be provided to measure and/or monitor the wellsite packets 117 passing through the rotary valve 563. In this example, the silo 544 is provided with supports 561 for holding the silo 544. The supports 561 may a base with legs to supports the silo 544 in position for receiving and dispensing the wellsite packets 117. The gauge 567 may be, for example, a load cell positioned along the supports 561 to measure changes in weight in the silo 544 thereby determining the quantity of wellsite packets 117 dispensed from the silo 544. A knife may also be provided about the rotary valve 563 to selectively cut the wellsite packets 117 passing thereby.

As shown in FIG. 5.3, the metering device is a gate assembly 152.3 including a gate valve 569 and a sensor 571. The silo 544 is positioned for receiving the wellsite packets 117. The gate valve 569 is slidably movable between an open and a closed position to selectively align a passage therethrough in alignment with outlet 549 to selectively release wellsite materials therefrom and into mixer 160. The sensor 571 may optionally be a counter provided to measure the number of wellsite packets passing therethrough outlet 549 to assist in metering desired amounts of wellsite materials out of the silo 544. The counter may be, for example, an optical, ultrasound, microwave or other sensor capable of detecting amounts of wellsite packets 117 passing therethrough.

As shown in FIG. 5.4, the metering device is a conveyer 152.4 similar to the conveyor 144.2 of FIG. 2.2 with a gate valve 569 as in FIG. 5.3 and a load cell 567 as in FIG. 5.2. The silo 134.1 contains the wellsite packets 117. The gate valve 569 is slidably movable between an open and a closed position to selectively align a passage therethrough in alignment with outlet 549 to selectively release wellsite materials therefrom and into mixer 160. The load cell 567 is positioned on the conveyor to sense the weight of the wellsite packets 117 thereon. Based on the load cell 567, the speed of the conveyor 152.4 and the release of wellsite materials out of the silo 544 through the gate valve 569 may be controlled. The control unit 142 may be used to control the amount of wellsite packets 117 passed into the mixer 160.

Part or all of the handling system 100 may optionally be separate or integral. Part or all of the handling system 100 may also be optionally separate from or integral with surface equipment 106 and/or downhole equipment 108 (e.g., treatment systems 112).

Figure 6:
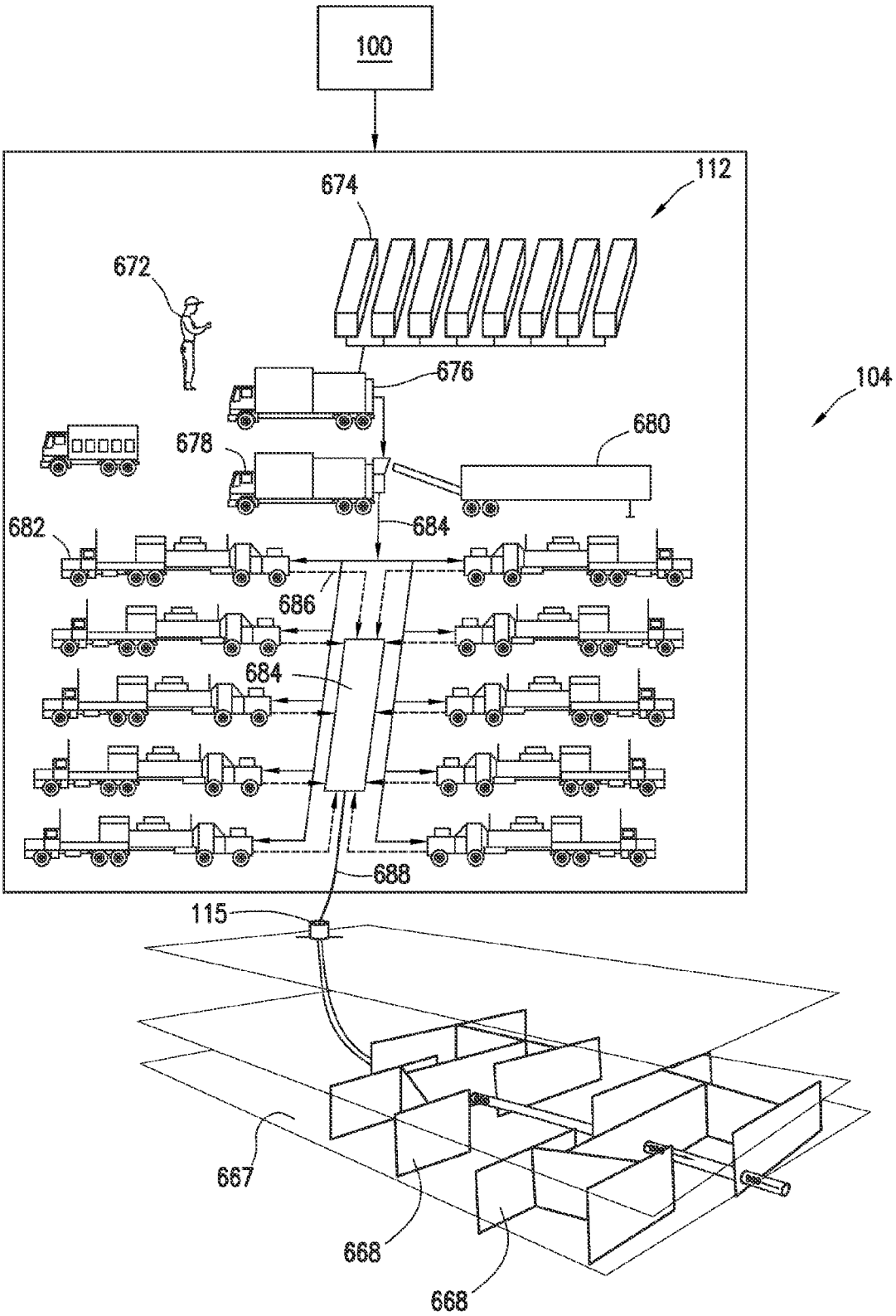
FIG. 6 is a schematic illustration of a handling system and a treatment system of a wellsite handling system in accordance with an embodiment of the present disclosure.

FIG. 6 shows the wellsite 104 and the handling system 100 with an example surface treatment system 112. The surface treatment system 112 as shown is located at the wellsite 104 for injecting treatment fluids to fracture a formation 667 surrounding the wellbore 115 and form fracture networks 668 therein. The treatment system 112 receives the wellsite mixture from the handling system 100 and provides them to the wellbore 115. The wellsite mixture may be treatment fluids usable in fracturing formations surrounding the wellbore. In some cases, additional fluids may be added to the wellsite mixture by the treatment system 112 to provide the desired mixture of wellsite materials and/or treatment fluids to the wellbore 115.

The treatment system 112 includes a pump system (depicted as being operated by a field operator 672) for operating the system 112 in accordance with a prescribed plan/schedule. The treatment system 112 pumps fluid from the surface to the wellbore 115 during a fracture operation.

The treatment system 112 includes a plurality of water tanks 674, which feed water to a gel hydration unit 676. The gel hydration unit 676 combines water from the tanks 674 with a gelling agent to form a gel. The gel is then sent to a mixing unit, shown as a blender 678, where it is mixed with a proppant from a proppant transport 680 to form a fracturing fluid. The solid particles (e.g., guar) used to form the gel may be provided to the blender 678 in wellsite packets 117. The gelling agent may be used to increase the viscosity of the fracturing fluid, and to allow the proppant to be suspended in the fracturing fluid. It may also act as a friction reducing agent to allow higher pump rates with less frictional pressure.

The treatment fluid is then pumped from the blender 678 to the pumping trucks 682 with plunger pumps as shown by solid lines 684. Each treatment truck 678 receives the fracturing fluid at a low pressure and discharges it to a common manifold 685 (sometimes called a missile trailer or missile) at a high pressure as shown by dashed lines 686. The missile 685 then directs the fracturing fluid from the pumping trucks 682 to the wellbore 115 as shown by solid line 688. One or more pumping trucks 682 may be used to supply fracturing fluid at a desired rate.

Each pumping truck 682 may be normally operated at any rate, such as well under its maximum operating capacity. Operating the pumping trucks 682 under their operating capacity may allow for one to fail and the remaining to be run at a higher speed in order to make up for the absence of the failed pump. A computerized control system may be employed to direct the entire treatment system 112 during the fracturing operation.

The treatment fluids may include various fluids, such as conventional stimulation fluids with proppants, may be used to create fractures. Other fluids, such as viscous gels or "slick water" (which may have a friction reducer (polymer) and water), may also be used to hydraulically fracture shale gas wells. Such "slick water" may be in the form of a thin fluid (e.g., nearly the same viscosity as water) and may be used to create more complex fractures, such as multiple micro-seismic fractures detectable by monitoring. The wellsite mixture provided by the handling system may include part or all of the treatment fluids. Additional fluids may be added along the handling and/or treatment systems as desired.

Figure 7:
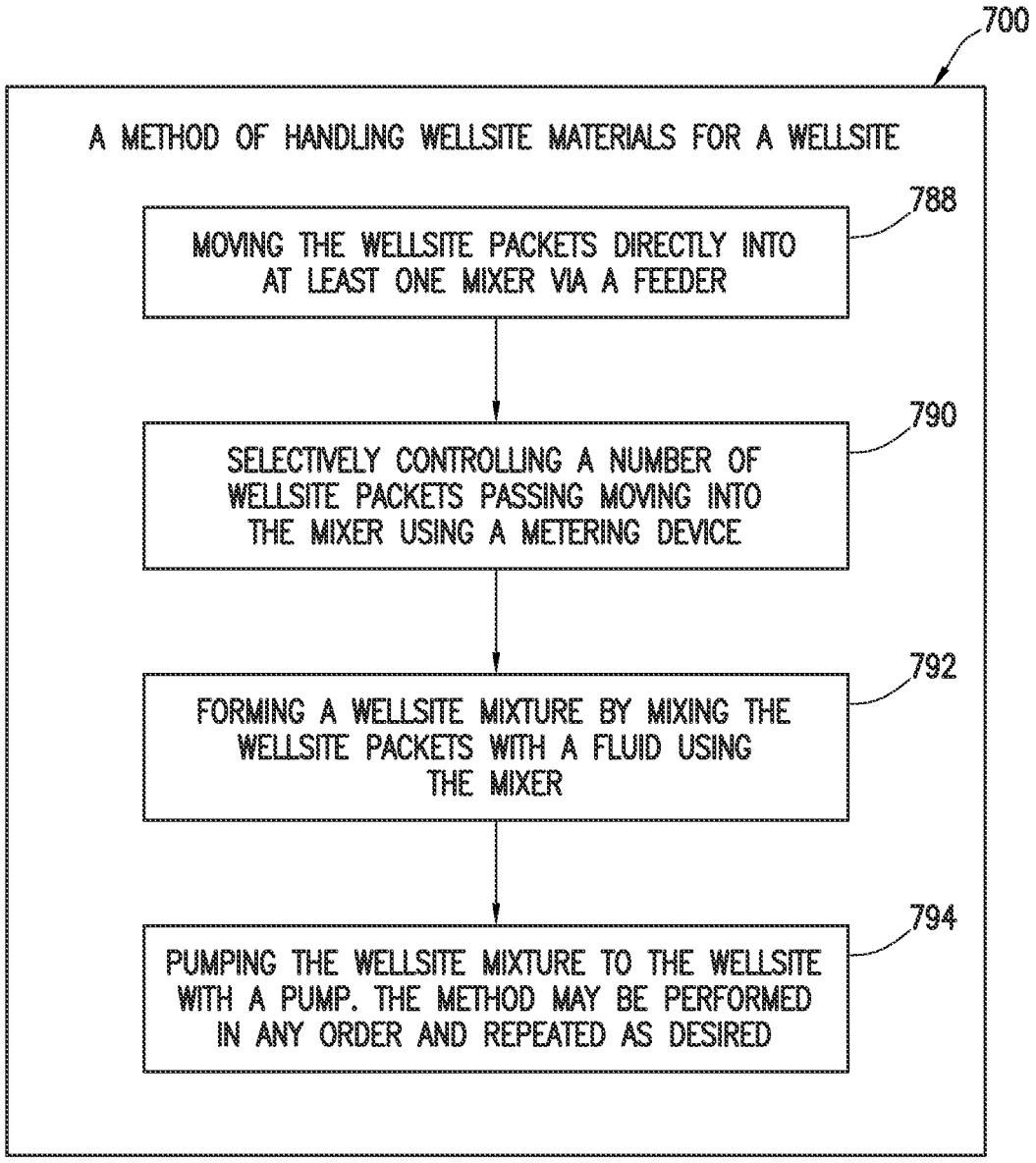
FIG. 7 is a flow chart depicting a method of handling wellsite materials.

FIG. 7 shows a method 700 of handling wellsite materials for a wellsite. The method involves 788—moving the wellsite packets directly or indirectly into at least one mixer via a feeder, 790—selectively controlling a number of wellsite packets moving into the mixer using a metering device, 792 forming a wellsite mixture by mixing the wellsite packets with a fluid using the mixer, and 794—pumping the wellsite mixture to the wellsite with a pump. The method may be performed in any order and repeated as desired.

Although only a few example embodiments have been described in detail above, those skilled in the art will readily appreciate that many modifications are possible in the example embodiments without materially departing from the system and method for performing wellbore stimulation operations. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. §112, paragraph 6, for any limitations of any of the claims herein, except for those in which the claim expressly uses the words 'means for' together with an associated function.

What is claimed is:

1. A system for handling wellsite packets for a wellsite, the wellsite packets comprising packaging with wellsite materials therein, the wellsite having surface equipment and downhole equipment positioned about a wellbore penetrating a subterranean formation, the handling system comprising:

at least one feeder comprising a reel rotationally mounted on a reel support, a chain of the wellsite packets releasably wound about the reel, the chain of wellsite packets unwindable from the reel and into at least one receptacle;

at least one mixer operatively coupled to the at least one receptacle, the at least one mixer to mix the wellsite packets with a fluid to form a wellsite mixture; and a pump operatively coupled to the at least one mixer to pump the wellsite mixture to the wellsite.

2. The handling system of claim 1, further comprising at least one metering device comprising a gate operatively connectable to the at least one feeder and having a passage therethrough, the gate movable between an open and closed position to selectively control a number of wellsite packets moving from the at least one feeder through the passage and into the at least one mixer.

3. The handling system of claim 1, further comprising a motor to rotationally drive the reel.

4. The handling system of claim 1, further comprising drums to receive packaging from the chain of wellsite packets, the packaging removable by the drums whereby the wellsite materials are releasable therefrom.

5. The handling system of claim 4, wherein the gate comprises a knife to cut the chain.

* * * * *